United States Patent [19]

Valori et al.

[11] Patent Number: 4,594,959

[45] Date of Patent: Jun. 17, 1986

[54] LOCKING DEVICE FOR REMOVABLE SEWING-MACHINE CONTROL CAMS

[75] Inventors: Giuseppe Valori, Monza; Marco Primati, Cinisello Balsamo, both of Italy

[73] Assignee: Stabilimento Industriale Singer, s.r.l., Monza, Italy

[21] Appl. No.: 739,111

[22] Filed: May 30, 1985

[30] Foreign Application Priority Data

Jun. 12, 1984 [IT] Italy ..... 22251/84[U]

[51] Int. Cl.[4] ..... D05B 3/02

[52] U.S. Cl. ..... 112/460; 403/349

[58] Field of Search ..... 403/348, 349; 112/158 A, 158 D, 463, 460

[56] References Cited

U.S. PATENT DOCUMENTS 2,120,623 6/1938 Oxford et al. ..... 403/349 X 3,541,981 11/1970 Watson ..... 112/158 A

FOREIGN PATENT DOCUMENTS 113683 4/1969 Denmark ..... 112/158 A

*Primary Examiner*—Werner H. Schroeder

*Assistant Examiner*—Andrew M. Falik

*Attorney, Agent, or Firm*—Murray and Whisenhunt

[57] ABSTRACT

The cams controlling the operation of sewing machines, in particular for selection of the type of sewing stitch, are made on a single support which can be replaced by removal from a special housing in the sewing machine and locked in operative position.

2 Claims, 7 Drawing Figures

LOCKING DEVICE FOR REMOVABLE SEWING-MACHINE CONTROL CAMS

The present invention relates to sewing machines and more specifically to the sewing stitch type selection cams.

It is known that in modern sewing machines selection of the sewing stitch is made by selecting an appropriate cam profile which regulates the operation cycle of the operative parts of the machine and in particular the operative cycle of the needles which perform the sewing.

These cam profiles are made on a single one-piece support which is explored by a sensor connected to a selector.

It is also known that, given the high number of types of sewing machine stitches which can be performed with a modern sewing machine it is equipped with a certain number of cam assemblies or supports of the aforesaid type so that their prompt and easy replacement becomes necessary.

The principal object of the present invention is to make available an effective device for replacement, locking and unlocking in position of the cam support with respect to the rotation shaft of same.

Said object is achieved with a locking device for sewing machine control cams of the type comprising a plurality of cams formed on the outer surface of a substantially cylindrical support characterized in that it comprises a locking part fitted with coupling elements designed to be introduced in operative position in the internal recess of said support, said locking part being mounted on a kinematic mechanism timed with said cam support, said support being fitted with an axial sleeve having a hole designed to receive the end of a centering shaft which is neutral with respect to said locking part and a stop designed to engage in a releasable manner said coupling elements of said locking part.

The invention will now be described in relation to the embodiments illustrated in the annexed drawings, wherein.

Figure 1:
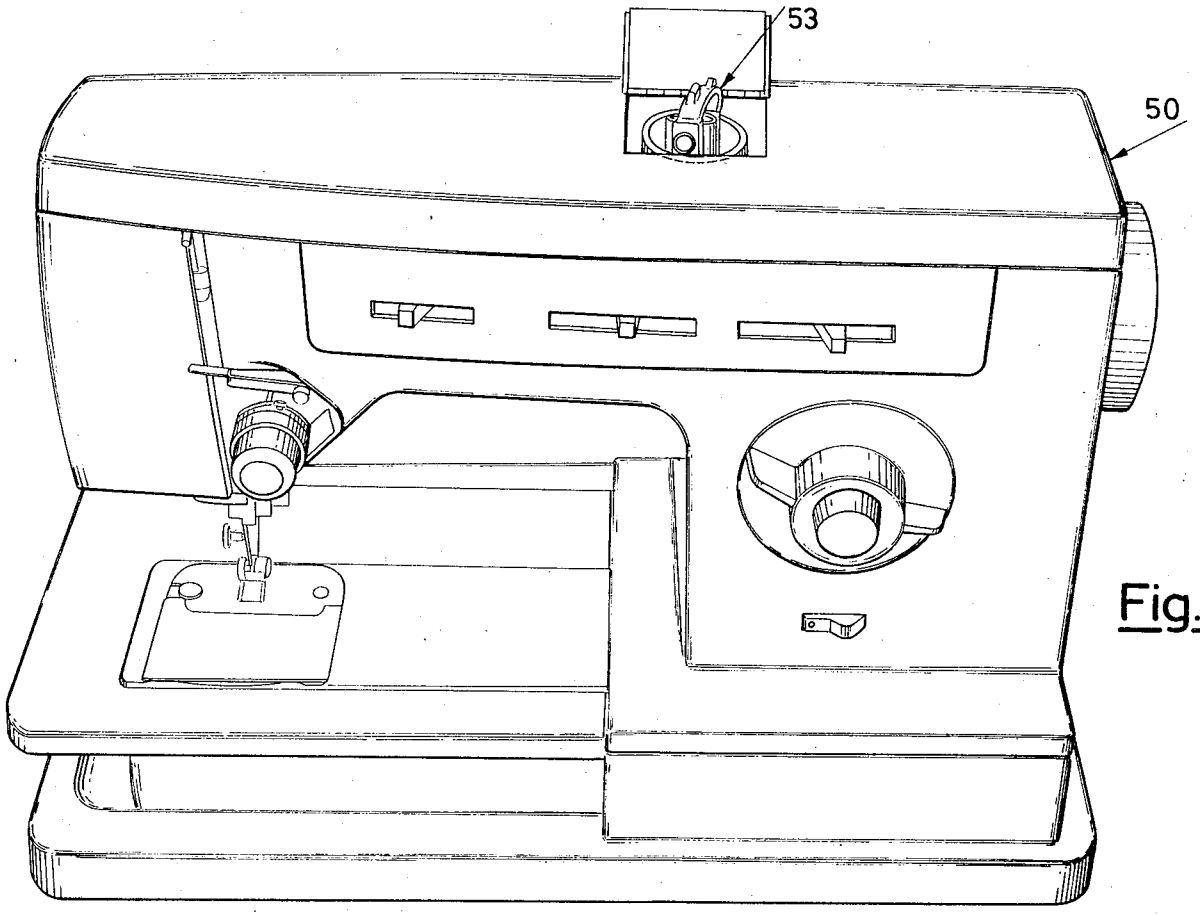
FIG. 1 is a perspective schematic view of a sewing machine incorporating the device according to the invention.

With reference to the drawings, number 50 indicates a sewing machine shown without the top cover 51 in which (FIG. 2) is hinged a door 52 which allows access to the device according to the invention indicated as a whole and generally with number 53.

With reference to the drawings, number 10 indicates a cylindrical tubular support on whose external surface are formed cam profiles 11 designed to be explored by a sensor which in turn controls in a known manner the parts which perform the sewing operations.

The sensor 54 is shiftable in a known manner on command from one profile to the other of the cam 11 by means of a selecting lever 55 and a known mechanism indicated wholly by reference number 56.

To the internal cylindrical surface 12 of the support 10 is fixed by a small block a central sleeve 14 which is coaxial with the axis of the support 10 and pierced axially as indicated by reference number 15.

On the top end of the sleeve 14 are formed two side pins 16 aligned on a diameter of the circular section of the sleeve.

Inside the support 10 between its cylindrical internal surface 17 and the external surface of the sleeve 14 is insertable an anchoring element 18 forming two locking teeth 19 having the purpose described below and equipped with a base 20 having a central hole 21 designed to arrange itself coaxially with the hole 15 in the sleeve 14 against which said base rests.

The anchor block 13 also has two through steps 22 with a rectangular cross section and two regulating and adjusting slots 26 at 90 degrees.

To couple the element 18 to the support and centering shaft or pin 23 whose purpose is to support in a central position the cam support 10 during its rotation, the base 20 is fixed to the top circular base 57 of a sleeve 58 which is mounted in a turning manner on the shaft 23 and bears a pinion gear 59 meshed with a worm 60 to operate the pinion gear and hence to rotate the anchor element 18 and with it the support 10 bearing the cam profiles 11.

The base 20 is secured to the base 57 of the sleeve 58 by means of the screws 61. To regulate and hence time the position of the support 18 and hence of the support 10 of the cam profiles 11 the screws 61 pass into openings 62 formed in the base 20, the openings 62 having an extended form so that the angular position of the anchoring element 18 and hence of the support 10 with respect to the sleeve 69 can be adjusted finely.

The cam support 10 is thus mounted and locked as needed on the anchoring element 18.

To achieve this, on the pins 16 protruding from the sleeve 14 is mounted in a rotating manner a substantially U-shaped handle 27 the inside of which has blind holes 28 for mounting on the pins 16 while the sides of the U have on the outside semicircular locking elements 29 which upon rotation of the handle 27 around the pins 16 engage with the locking teeth 19 of the locking part 18 which is assembled integrally in a turning manner with the shaft 23.

As a result the cam support 10 can be rapidly mounted and removed with respect to the shaft 23 and hence made to be rotated by the latter.

Operation of the device according to the invention is consequently very clear.

In the beginning there is the shaft 23 which bears the locking part 18 fixed to it in the aforesaid manner.

The cam support 10 is fitted on the locking part 18 in such a manner that the central pin 23 enters the axial hole 15 of the sleeve 14, bringing the locking teeth 19 into a position suitable for engagement by the corresponding locking elements 29 of the handle 27.

Figure 2:
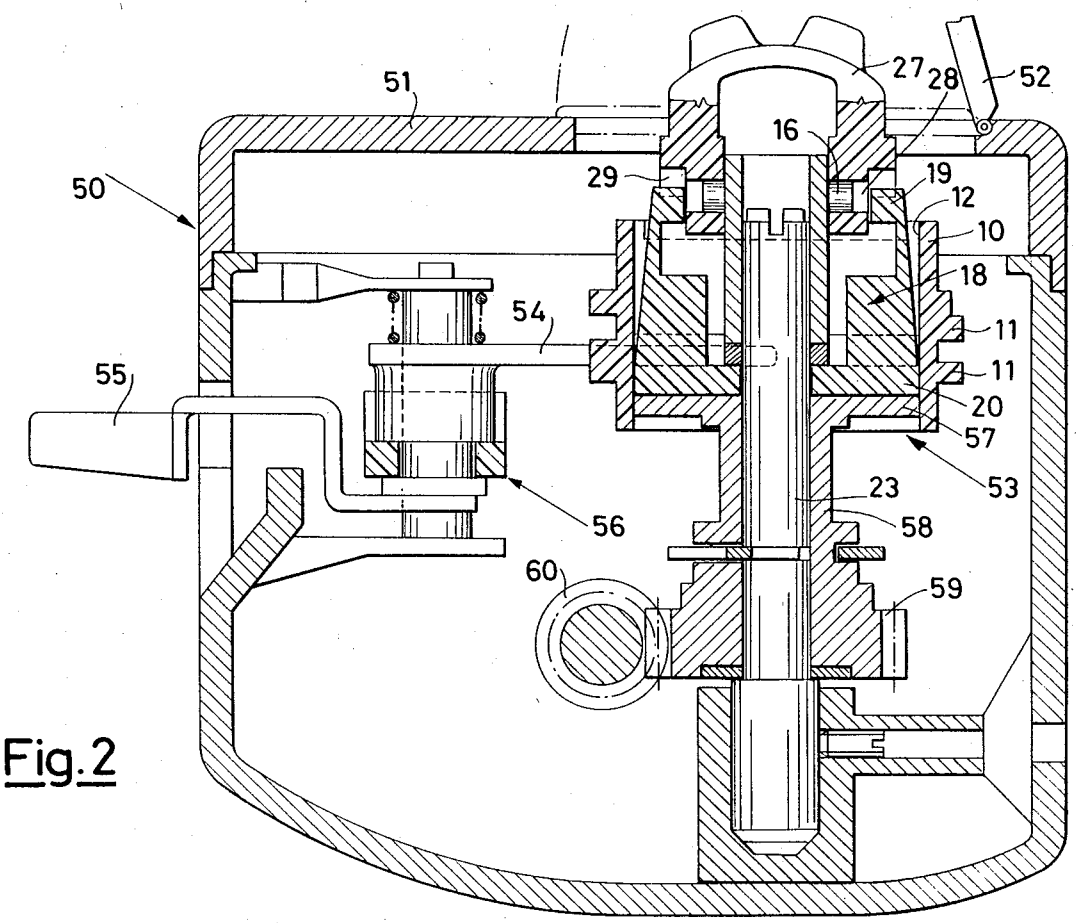
FIG. 2 is a partial cross section of the sewing machine of FIG. 1 with the device of the invention in unlocked position.
Figure 3:
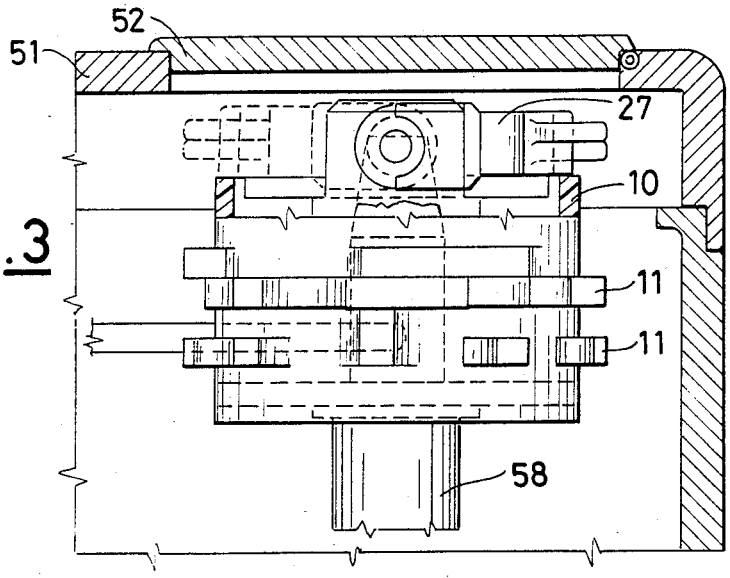
FIG. 3 is a view similar to that in FIG. 2, although limited to the device, shown closed.
Figure 6:
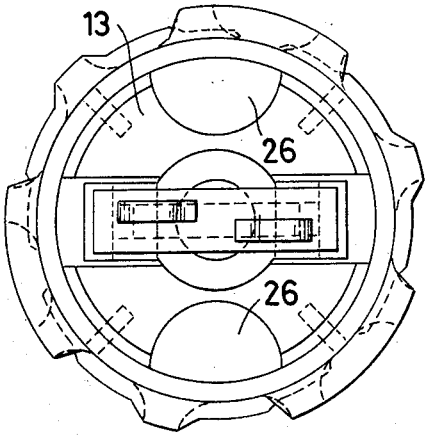
FIGS. 6 and 7 are plan views of the device shown in FIG. 4 seen in the direction of arrows A and B respectively.
Figure 7:
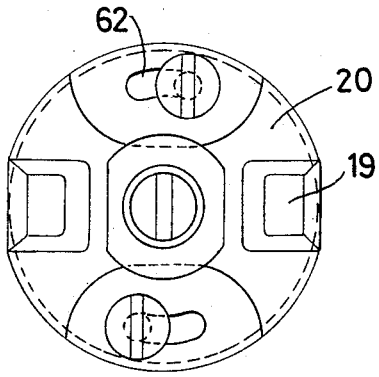
Figure 4:
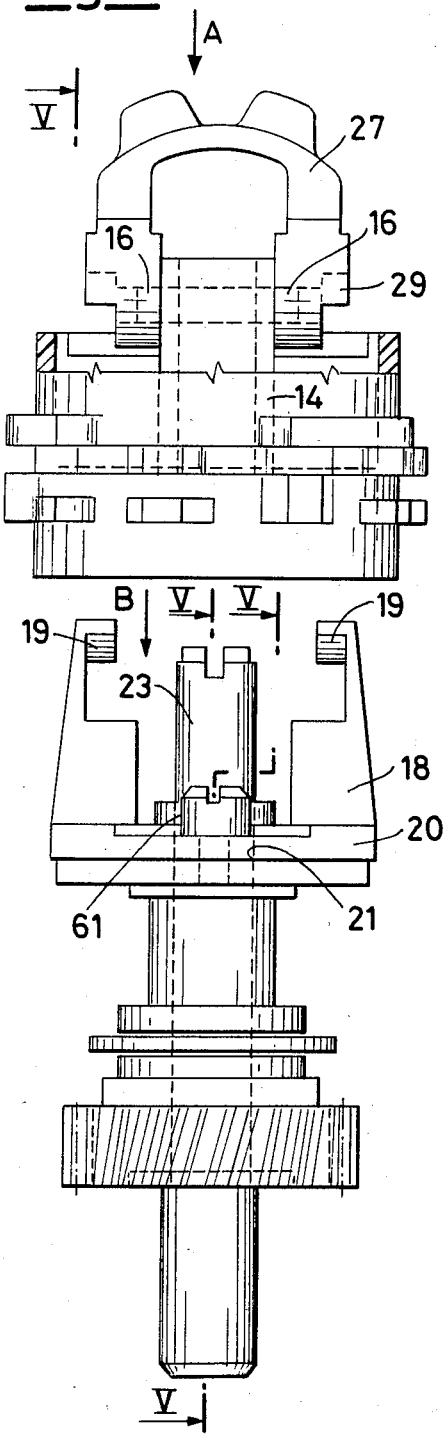
FIG. 4 is an exploded view of the device of the invention.
Figure 5:
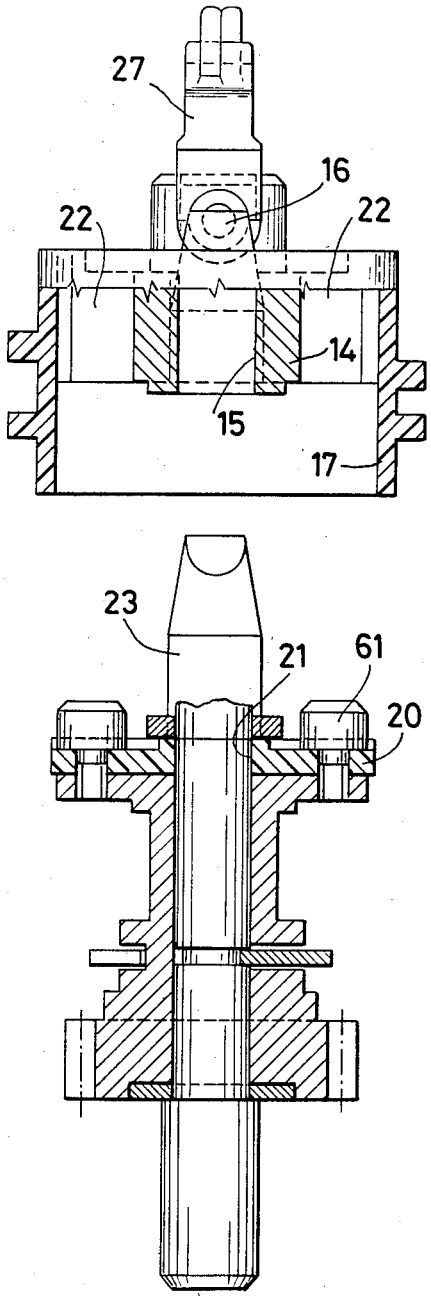
FIG. 5 is a cross section along plane of cut V—V of FIG. 4.

Rotation of the handle 27 in either direction toward the position shown in FIG. 3 causes locking of the support 10 to the locking element 18 while opposite rotation to the intermediate position shown in FIG. 2 is sufficient to release it.

The invention has been described in relation to a preferred embodiment but it is understood that conceptually and mechanically equivalent modifications and variants are possible and foreseable without exceeding its scope.

We claim:

1. A locking device for sewing machine control cams having a plurality of cams formed on the outer surface of a substantially cylindrical support having an internal cavity, said device comprising a locking part fitted with coupling elements designed to be introduced in operative position in said internal cavity, said locking part being mounted on a kinematic rotation mechanism timed with said cam support, said support having an axial sleeve having a hole, a centering shaft having an end receivable in said hole, and a stop designed to releasably engage said coupling elements of said locking part, said stop comprising a U-shaped handle having sides, said axial sleeve having two aligned pins, said sides pivoted on said pins, said handle having stop teeth which upon rotation of said handle engage the connecting elements of the locking part.

2. Device of claim 1, wherein said stop teeth comprise a semicircular protrusion turning together with said handle and coaxial with said aligned pins protruding from said sleeve.

* * * * *